US008689766B2

(12) United States Patent
Oledzki

(10) Patent No.: US 8,689,766 B2
(45) **Date of Patent: *Apr. 8, 2014**

(54) SPHERICAL TWO STROKE ENGINE SYSTEM

(76) Inventor: Wieslaw Julian Oledzki, Bialystok (PL)

( * ) Notice: Subject to any disclaimer, the term of this patent is extended or adjusted under 35 U.S.C. 154(b) by 1103 days.

This patent is subject to a terminal disclaimer.

(21) Appl. No.: 12/313,312

(22) Filed: Nov. 20, 2008

(65) Prior Publication Data

US 2010/0122685 A1 May 20, 2010

(51) Int. Cl.

| | |
|---|---|
| ***F02B 53/00*** | (2006.01) |
| ***F01C 3/00*** | (2006.01) |
| ***F01C 1/063*** | (2006.01) |
| ***F04C 3/00*** | (2006.01) |
| ***F04C 2/00*** | (2006.01) |
| ***F04C 18/00*** | (2006.01) |

(52) U.S. Cl.

USPC ..... 123/241; 123/242; 418/68; 418/53; 418/193; 418/195

(58) Field of Classification Search

USPC ..... 123/241–242; 418/68, 51, 53, 195, 193

See application file for complete search history.

(56) References Cited

U.S. PATENT DOCUMENTS

| | | | | | |
|---|---|---|---|---|---|
| 826,985 | A * | 7/1906 | Appel | 418/68 |
| 1,946,343 | A * | 2/1934 | Wicha | 418/53 |
| 1,946,344 | A * | 2/1934 | Wicha | 418/53 |
| 1,967,167 | A * | 7/1934 | Weis | 418/68 |
| 1,984,447 | A * | 12/1934 | Wicha | 418/53 |
| 1,986,454 | A * | 1/1935 | Wicha | 418/53 |
| 2,031,125 | A * | 2/1936 | Peschl | 418/53 |
| 2,482,325 | A * | 9/1949 | Davis | 418/193 |
| 3,040,664 | A * | 6/1962 | Hartley | 418/193 |
| 3,106,912 | A * | 10/1963 | Kahlert | 418/195 |
| 3,277,792 | A * | 10/1966 | Stenerson | 418/193 |
| 3,528,242 | A * | 9/1970 | Hartmann | 418/193 |
| 3,847,515 | A * | 11/1974 | Caldwell | 418/193 |
| 3,984,981 | A * | 10/1976 | Redshaw | 60/519 |
| 4,799,870 | A * | 1/1989 | McMaster | 418/193 |
| 5,147,193 | A * | 9/1992 | Larsen | 418/68 |
| 6,241,493 | B1 * | 6/2001 | Turner | 418/68 |
| 6,739,852 | B1 * | 5/2004 | Klassen | 418/195 |

* cited by examiner

*Primary Examiner* — Thai Ba Trieu

(57) ABSTRACT

A positive displacement internal combustion engine with the strongest mechanism for converting thermal energy of combustion gases to rotational motion, being composed of a body with spherical combustion chamber, and three spatial eccentrics being placed in said spherical chamber. The mechanism is particularly suitable for heavily loaded detonation and homogeneous charge compression ignition engines.

6 Claims, 13 Drawing Sheets

SPHERICAL TWO STROKE ENGINE SYSTEM

TECHNICAL FIELD OF THE INVENTION

The invention relates to heat engines and more specifically to positive displacement internal combustion engines, and is particularly concerned with rotary and oscillating spherical engines i.e. engines, in which piston executes rotary/oscillating motion and combustion chamber and principal engine's parts that converts gas pressure into rotary movement assume general form of sphere. The invention provides the optimal, "canonical" form for the two stroke rotary and oscillating spherical engine of unique strength and compactness.

STATE OF THE ART AND BACKGROUND OF THE INVENTION

Existing successful heat engines are steam turbines, gas turbines and positive displacement engines (reciprocating piston and rotary Wankel) utilizing various thermodynamic cycles (Diesel (or rather Sabathe), Otto and Stirling cycle). These engines, although now having been developed for more than century (almost 2 centuries in the case of Stirling), still stop short from fulfilling the requirements imposed on prime movers by modern economy. Thus steam turbines require huge steam boilers and steam condensers and are troublesome to exploit, therefore their applications are restricted to power plants and propulsion of ships and some other heavy machinery. Gas turbines, thermal efficiency of which can achieve even 65% in large units destined for power generation and industrial applications (e.g. in most recent large turbines built by GE, which in fact are compound heat machines with large heat exchanger), usually, particularly in small units, display much poorer figure than positive displacement engines, are more complicated technologically and more expensive, and therefore are unlikely to earn as dominant position as Diesels enjoy today due to these and other well-known inherent drawbacks and limitations. Thus positive displacement engines still have important advantages over turbines that render them irreplaceable for most applications.

Most common positive displacement engine in use (and in fact most common heat engine), Diesel engine, achieves maximum overall efficiency of slightly beyond 50% (large stationary or marine units, which again are compound heat machines comprising Diesel engine, turbocharger, supercharging air cooler and auxiliary power turbine), and average Diesel efficiency is merely ~40%, a poor figure in comparison with 70-75% originally assumed by its inventor in late $19^{th}$ century. Thermal efficiency of Diesel cycle rises with the compression ratio, but this method for improving overall efficiency of real Diesel engines is obstructed by friction loses rapidly rising with loads of engine's mechanism. Moreover, conventional connecting rod—crank mechanism's strength becomes a concern in highly loaded Diesel engines.

Another well-known positive displacement heat engine is the (external combustion) Stirling engine. This engine is closest to the ideal Carnot engine in terms of thermal efficiency, and another important advantage over known internal combustion engines is its capability to utilize various sources of thermal energy. However, Stirling engine is expensive to manufacture and troublesome to maintain, and this renders it considerably inferior to internal combustion engine in most applications, and prevents from earning wide acceptance.

There are many non-conventional designs of heat engines (most of them focusing on transforming gas force into driving torque of rotating shaft), e.g. rotary engines like Wankel, recently patented quasi turbine (see U.S. Pat. Nos. 6,164,263 and 6,899,075), spherical engines (see U.S. Pat. Nos. 6,325,038, and 6,941,900, and Russian patent 2,227,211) and oscillating pivotal engine (see www.PivotalEngine.com). However, so far none of those non-conventional engines, with Wankel-type engine being the only exception of economically (but certainly not conceptually) marginal importance, was successful, and probably none of them has any chance to even go beyond the stage of prototyping. Technically, this is due to the fact that the answer to the principal question any new engine is obliged to answer: "Does the new engine do its work better than conventional one?" is decidedly negative for all those non-conventional designs, including Wankel's. Even the answer to the more general question: "Does the new engine do its work in any aspect better than conventional one?" is negative for almost all non-conventional engines. (In the case of the Wankel engine, the answer to this more general question is positive, but superiority of Wankel over conventional engines in certain aspects (great power/weight and power/volume ratios, kinetic simplicity and smoothness of operation) is overshadowed by its inherent drawbacks (weak structure, inability to cope with large outputs, inferior efficiency, weakness of sealing, inherent inability to incorporate high compression ratios)). Conceptually, this is mainly due to the fact that those new engine designs (e.g. quasi turbine) focus on certain isolated aspects of heat engine while ignoring some other aspects (e.g. sealing, mechanical strength and reliability).

For example, recently patented positive displacement rotary engine, quasi-turbine, is complex both kinetically and structurally, its moving elements of complicated shapes are likely to be subjected to excessive thermal stresses and renders the engine weak structurally and more difficult to seal than Wankel engine; thus the engine is unlikely to do well the job of heat engine (it would be better as pump or compressor). Some other rotary engines (e.g. satellite engine, see publication WO9618024) use toothed wheels to transfer the pistons movement to rotary motion of engine's shaft. This not only makes these engines complex but also unreliable, as engine's elements that meet along a line are not well suited to bear shock loads met with in internal combustion engines.

Fuel cell is a very promising source of power for many applications, but it seems improbable it will become appropriate for applications where high power density is essential in any foreseeable future.

Thus there is a need for highly efficient universal source of mechanical power, and highly efficient and clean thermodynamic processes for producing hot high pressure gases, like detonation, compression ignited combustion of homogeneous charge and very high-pressure Sabathe cycle, render positive displacement internal combustion engines a very interesting proposition, provided that efficient way for converting thermal energy into useful mechanical power is incorporated. It is to be stressed that lack of such effective method for converting thermal energy into driving torque is an important obstacle to develop a practical Homogeneous Charge Compression Ignition (HCCI) and Positive Displacement Detonation (PDD) engine. The reason is that maximum gas forces themselves, as well as gradients of gas forces (understood as function of time), met with in HCCI and PDD engines (at least those utilizing stoichiometric mixture, which is the most efficient thermodynamically, and also most efficient from the point of view of power/weight and power/volume parameters) are much higher than in conventional IC engines, and conventional mechanisms are unable to cope with such extreme loads. This is one of the reasons, for which the planned "HCCI engines" are to utilize the more efficient HCCI mode of operation only while producing power at a moderate rate (and working on loan mixtures), converting into ordinary Diesel mode of operation when the power demand rises (the other reason is that IC engine working on loan mixture produces less pollutant nitrogen oxides).

It is to be stressed that none of the non-conventional engine designs in United States Patent and Trademark Office (USPTO) and European Patent Office (EPO) patent data bases offers satisfactory mechanical structure of the ICE suitable for coping with extreme loads while assuring engine's compactness and good sealing. Moreover, none of the known positive-displacement internal combustion engines approaches highly desirable structural simplicity of gas turbines.

SUMMARY OF THE INVENTION

Thus the principal objective of the present invention is to provide a high power density positive-displacement internal combustion engine of simple and extraordinarily robust structure, capable to withstand extremely high loads and thus to utilize highly efficient ultra-high pressure Diesel cycle or HCCI and PDD modes of operation without increasing specific loads of engine's elements beyond limits that are standard for ordinary piston engines and without decreasing mechanical efficiency of the engine.

Another objective of the invention is to provide a structure for a valve-less two stroke engine that guarantees good constraint for engine's piston and piston sealing elements.

Yet another objective of the invention is to provide a structure for the internal combustion engine with no hot load bearing sliding elements.

Another objective of the invention is to substantially increase thermal efficiency of engines by improving combustion and increasing such parameters as maximum combustion pressure without increasing specific loads of engine's parts.

Yet another objective of the invention is to provide a structure for positive displacement engines that offers substantial improvement of such important engine parameters as swept volume/total volume, power/total volume and power/weight ratio, without increasing specific loads and thus without sacrificing engine's strength and reliability.

Another objective of the invention is to provide a structure for the positive displacement engines that offer a large variety of engine's configurations (e.g. considerable variety of scavenging systems, ignition systems etc.) capable of being adjusted to various specific requirements.

Yet another objective of the invention is to provide rotary engines that have sealing almost as simple, tight and reliable as conventional ones and much simpler, tighter and much more reliable than conventional (Wankel) rotary engines.

It is clear that at the core of such an engine should be a mechanism, desirably the strongest and simplest mechanism in existence, that would provide the optimal method for converting gas pressure directly into rotary movement of a solid body.

In order to find such a mechanism some initial conditions should be imposed upon it. Thus gears (toothed wheels) or other mechanisms comprising elements meeting along a line, mechanisms complex from kinetic point of view (for example comprising elements executing complex motion) loaded with extreme gas forces and rendering the engine difficult to seal are unacceptable.

Thus the general idea behind the invention is to take a solid body, as regular as possible, cut out the combustion chamber, and cut the remaining portion of the body along some surfaces (preferably planes) into a minimum number of elements of a mechanism capable of converting gas pressure directly into driving torque (that is to say executing pure rotary movement, or at least "close" to it). This would provide the simplest, strongest, most robust and compact (no vacuum inside of the engine) structure of internal combustion engine, capable of bearing extreme mechanical loads produced by high-efficiency thermodynamic processes without increasing specific loads and friction losses, and substantially improving weight/power ratio at the same time, thus displaying substantial overall efficiency improvement over existing heat engines.

The construction of the strongest mechanisms in existence presented below provides strong indications that the proper form of the engine capable to satisfy all the above-formulated requirements is the oscillating or rotary/oscillating spherical engine.

Thus another, more specific objective of the present invention is to provide the proper form of the oscillating and rotary/oscillating spherical positive displacement engine without drawbacks (structural weakness, difficult sealing, compare U.S. Pat. No. 6,325,038, and U.S. Pat. No. 6,941,900, and Russian patent RU 2,227,211) of known spherical engines, having some specific qualities of gas turbines, namely high power density, structural simplicity combined with good driving torque smoothness, having scavenging system that makes the gas flow almost as smooth as (and similar to) that to be found in gas turbines and assuring engine's good balance thus enabling it to rotate at high speeds.

Spherical positive displacement machines (i.e. positive displacement machines with substantially spherical working chamber) are known from the prior art, however none of known designs provides a proper form of the machine, and the only mildly successful device of this type is a low-pressure pump (used to pump dense liquids, e.g. liquid soap). The reason is that the known designs (which usually adopt, at least partially, the general scheme of the universal joint) utilize elements of complicated and weak structure, which prevents the machines from exploring full potential (e.g. strength and compactness, ability to apply simple symmetric sealing) of mechanisms having a kind of spherical symmetry (see U.S. Pat. No. 6,325,038 and U.S. Pat. No. 6,941,900, and Russian patent RU 2,227,211; the design U.S. Pat. No. 6,325,038 is the best of its kind in the US and EPO patent data bases, however stops short of employing the optimal form of the spherical mechanism provided by the general principle of cutting a sphere along planes to obtain a mechanism presented in paragraph 3 above; it is to be stressed that an engine with the kinetics of the engine of the patent U.S. Pat. No. 6,325,038 is within the scope of the presented invention, and the machine provided by the method of paragraph 3 above is by far stronger and by far simpler structurally).

Thus the presented invention provides the proper form of the spherical engine, and explores to the full extent the potential of the spatial mechanism presented in a paragraph below i.e. its unique strength and compactness, possibility to apply simple completely symmetrical sealing, and variety of allowable kinetics. It is to be stressed that there is a considerable variety of spherical engines within my engine system, e.g. oscillating and rotary ones with a variety of scavenging systems, all based on the same mechanism.

Figure 6:
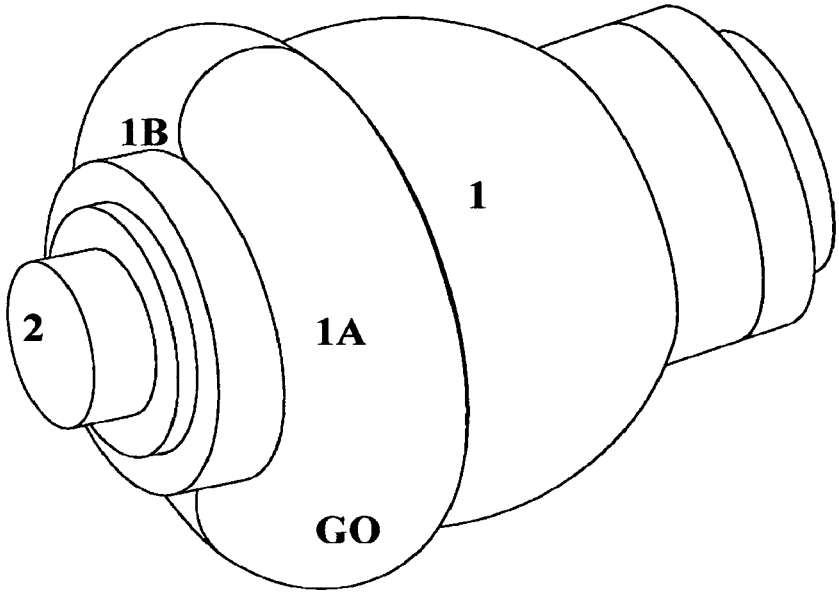
FIGS. 6-14 depict one preferred embodiment of the invention. This is a spherical HCCI engine producing 2 power impulses per shaft revolution.
Figure 7:
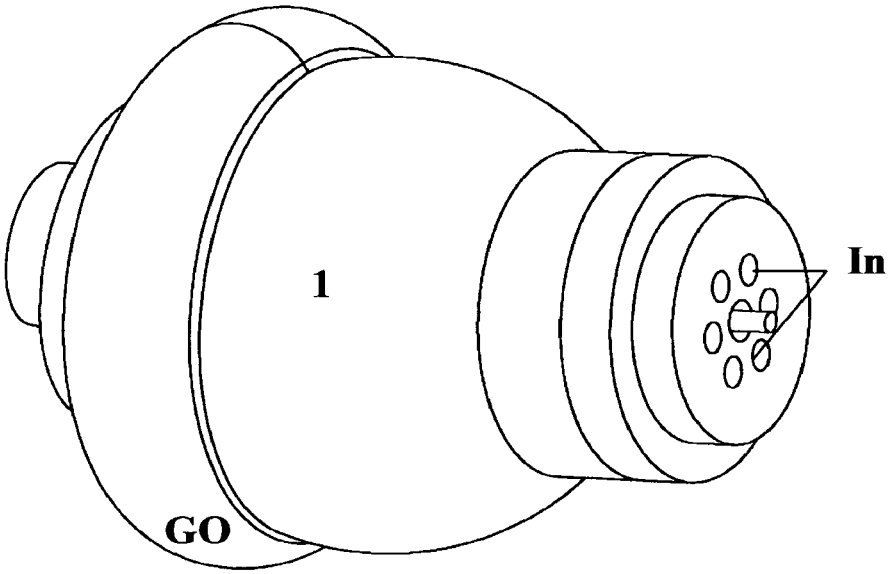
Figure 8:
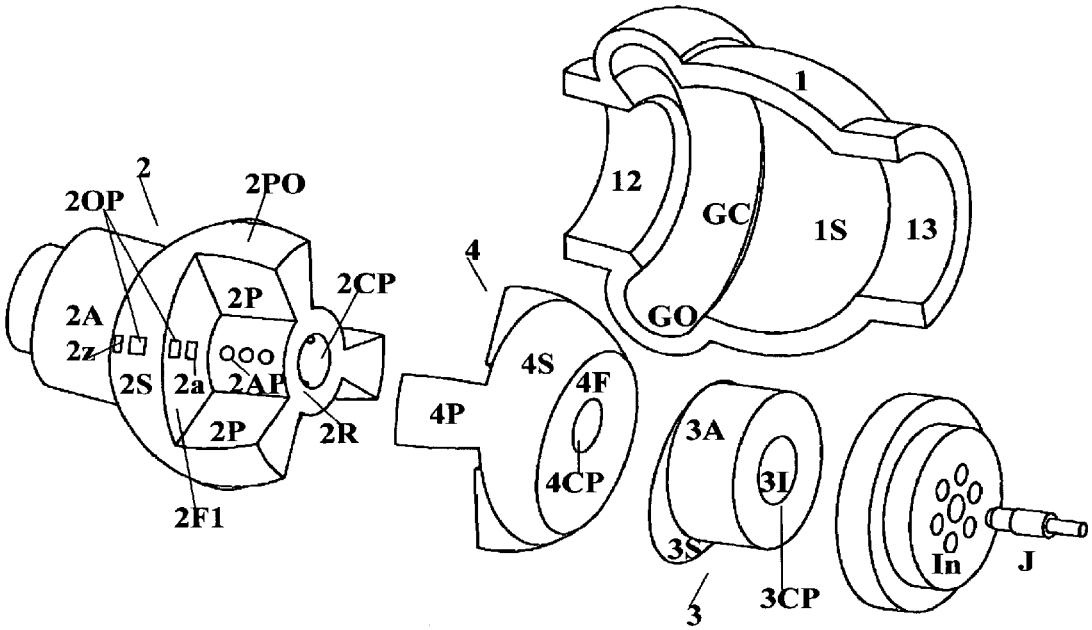
Figure 9:
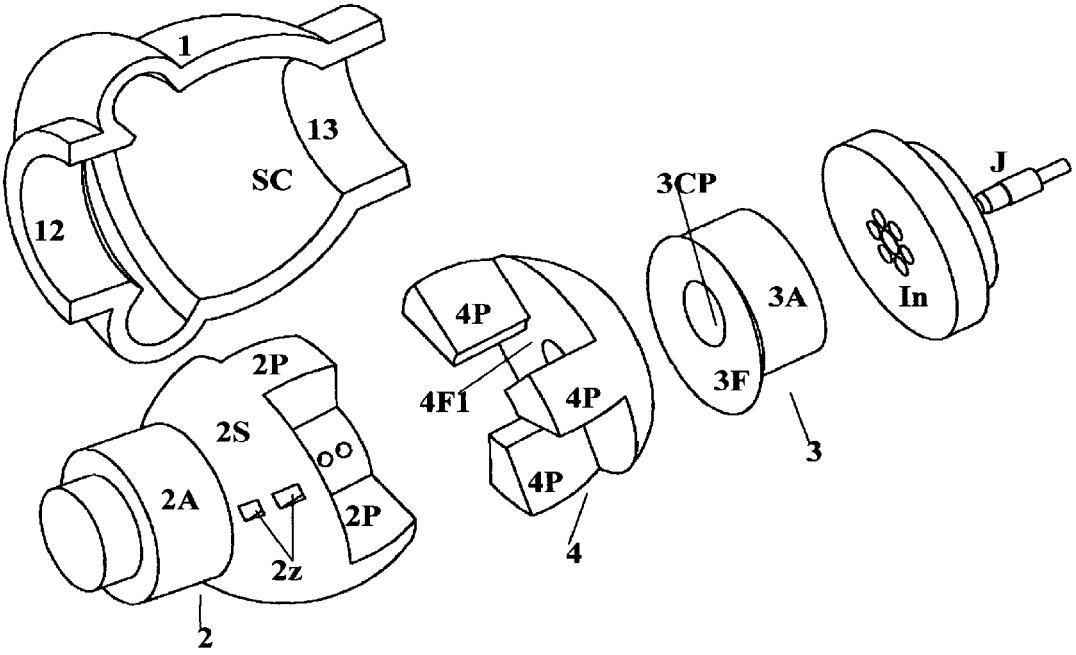
Figure 10:
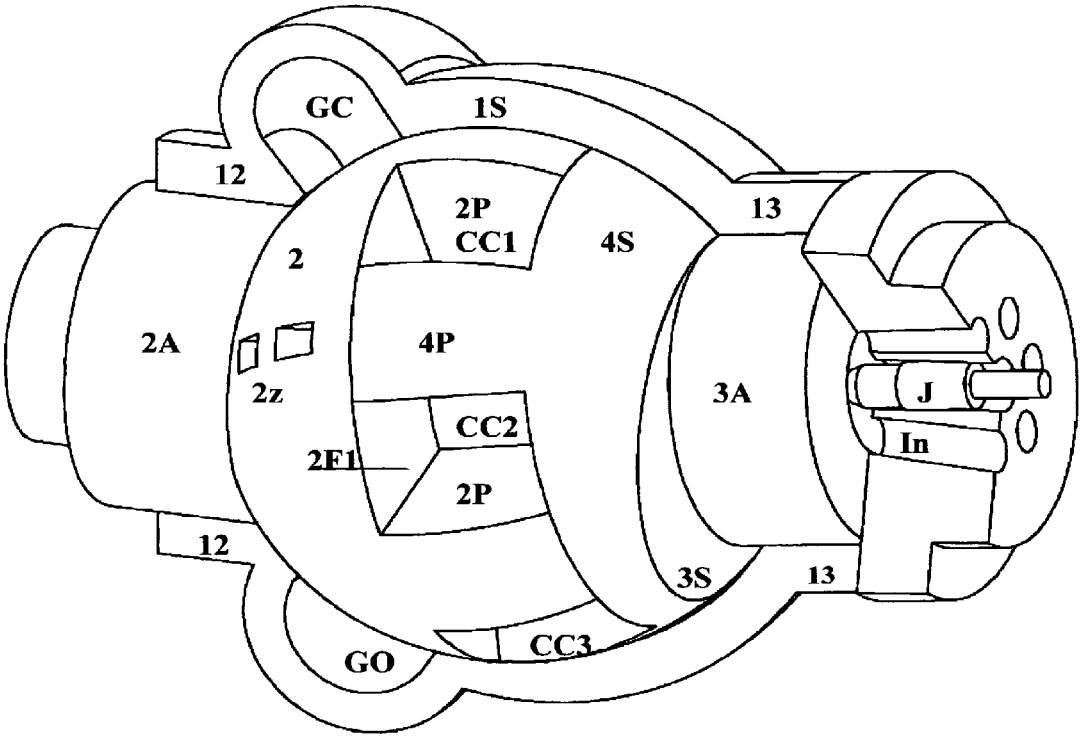
Figure 11:
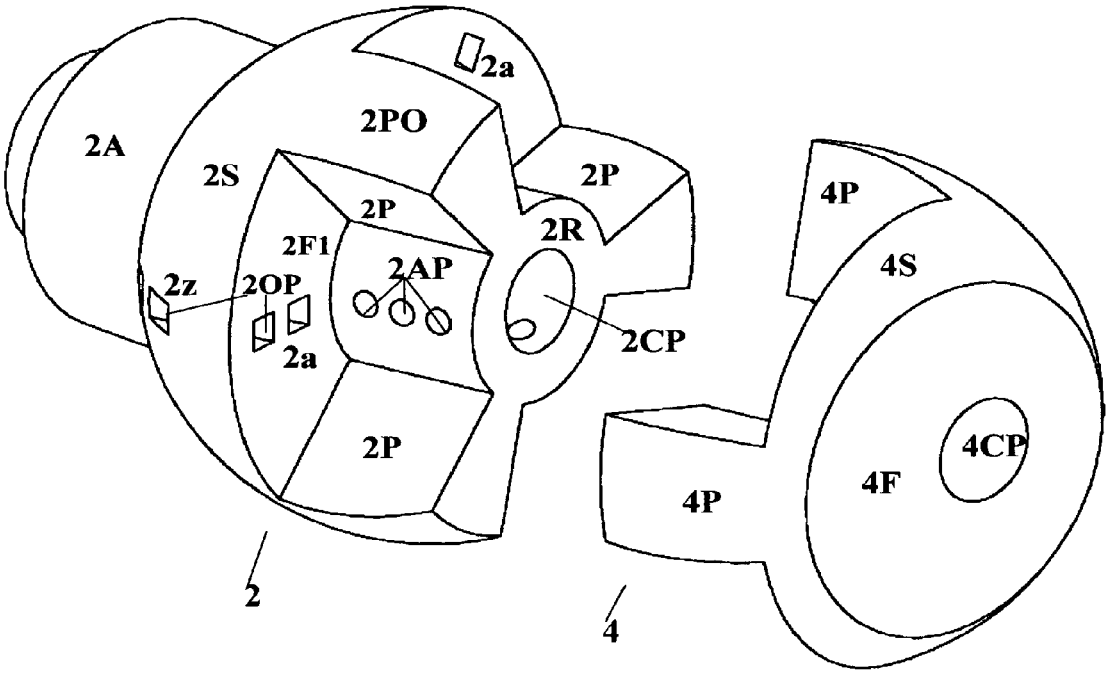
Figure 12:
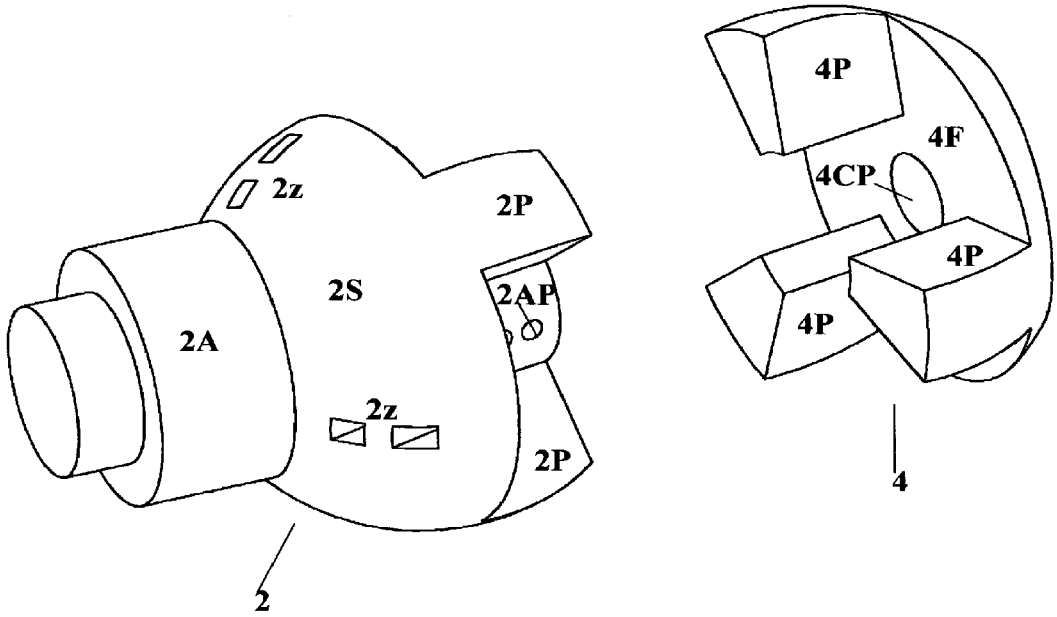
Figure 13:
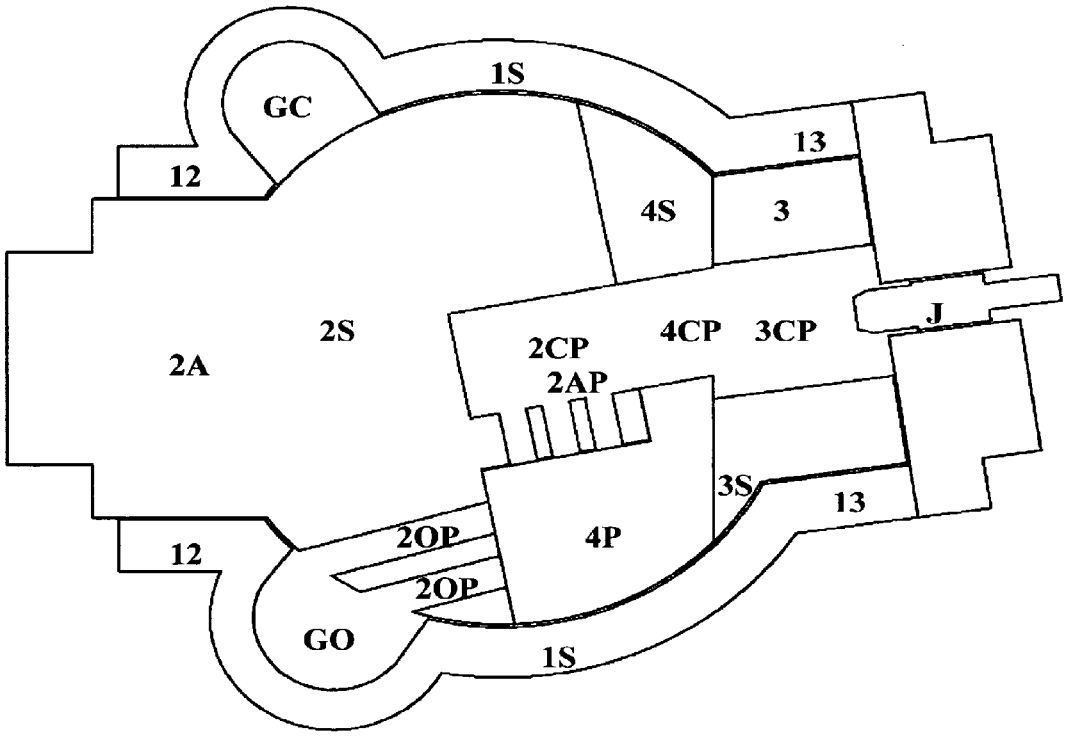
Figure 14:
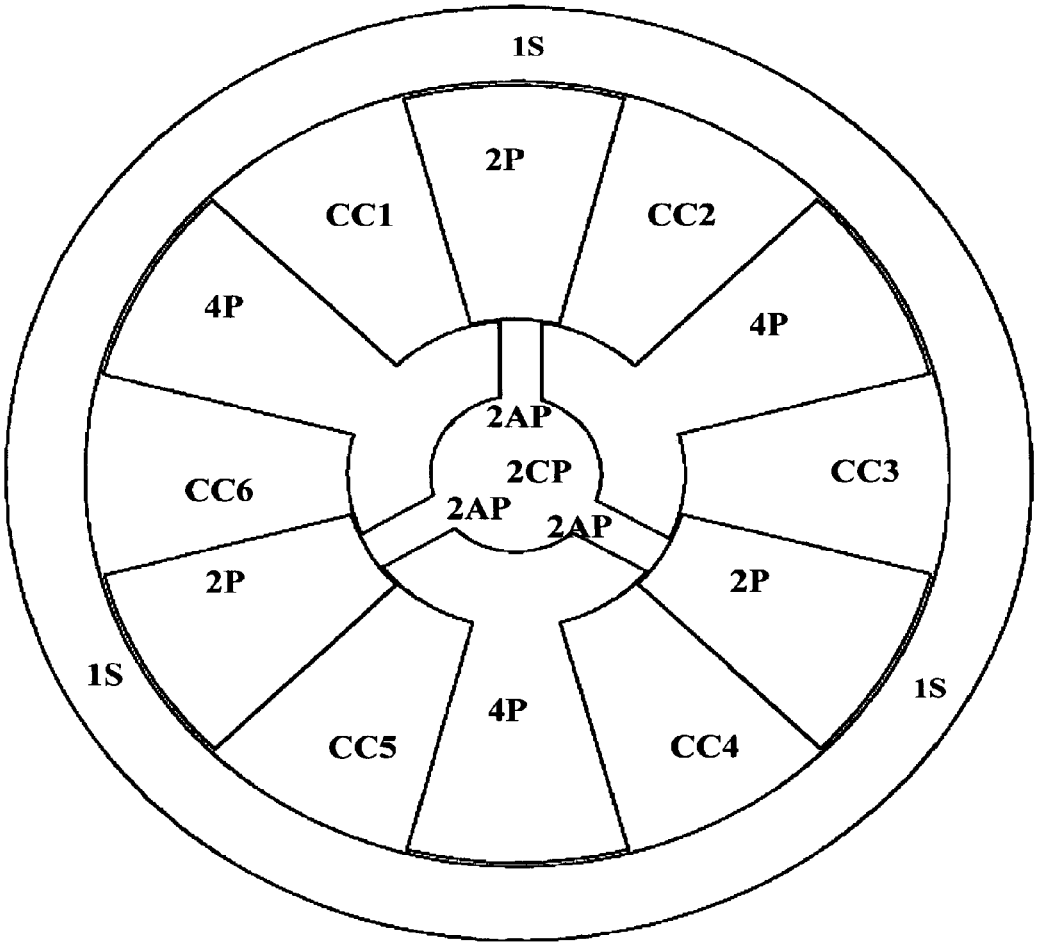

More specifically:

FIG. 6 is a general view of the engine,

FIG. 7 is another general view of the engine,

FIG. 8 is an expanded view of the engine;

FIG. 9 is another expanded view of the engine;

FIG. 10 is a cut-away view of the engine in the assembled configuration;

FIG. 11 provides details of engine's main spatial eccentric;

FIG. 12 provides details of engine's intermediate spatial eccentric;

FIG. 13 is a longitudinal cross-section of the engine;

FIG. 14 is a transverse cross-section of the engine.

DETAILED DESCRIPTION OF THE PREFERRED EMBODIMENTS

0. Main Geometric Construction

Now I present a short description of my method for achieving the strongest mechanism in existence capable of being applied in positive displacement engines. In fact the construction of these mechanisms lies at the very heart of the present invention.

The construction will be carried out in several simple steps (see FIGS. 1-5).

Figure 1:
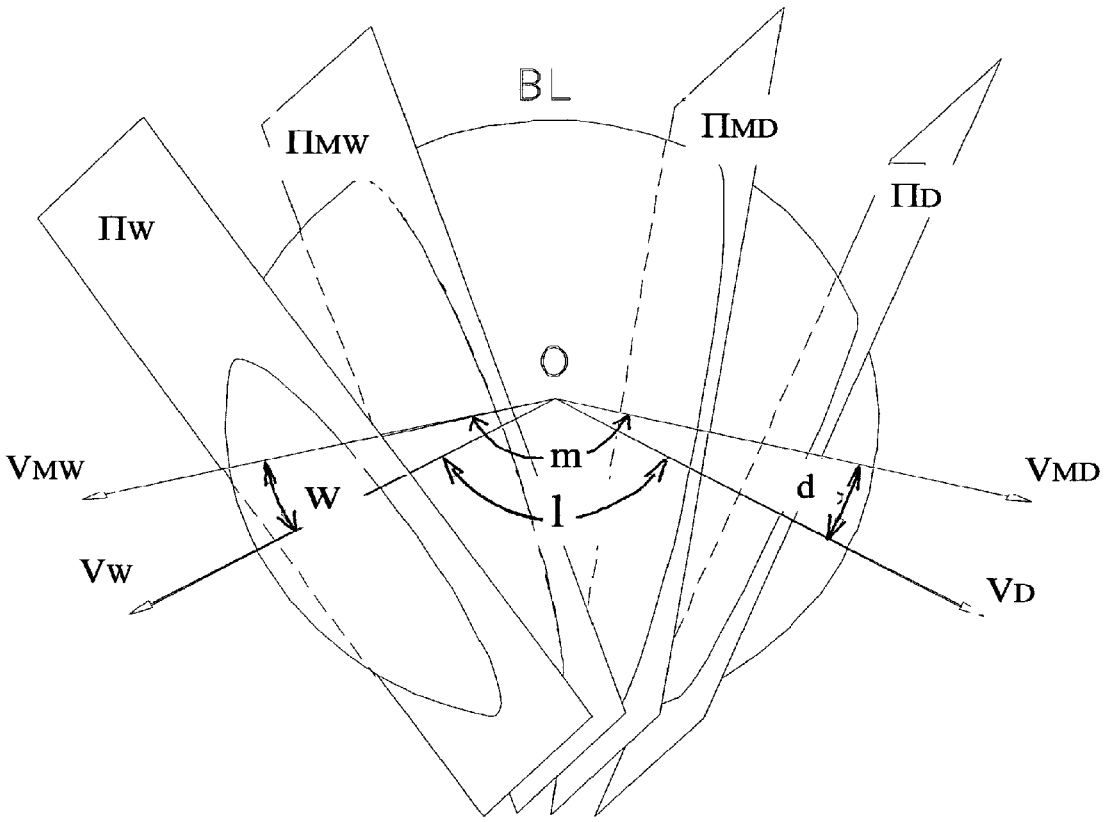
FIG. 1 illustrate the first step of the construction of my mechanisms described in the next paragraph.

A. In the Euclidean 3-dimensional space choose a ball BL of radius R and center O and four vectors $v_w$, $v_d$, $v_{mw}$ and $v_{md}$ of length R and based at the point O (FIG. 1). Any two of these vectors should not be parallel. Let w (resp. d; resp. m; resp. l) be the angle between the vectors $v_w$, $v_{mw}$ (resp. $v_d$, $v_{md}$; resp. $v_{mw}$, $v_{md}$; resp. $v_w$, $v_d$);

B. Fix planes π(w), π(d), π(mw) and π(md) perpendicular to the vectors $v_w$, $v_d$, $v_{mw}$ and $v_{md}$ respectively so as each of these planes non-trivially intersects the ball BL (FIG. 1).

Figure 2:
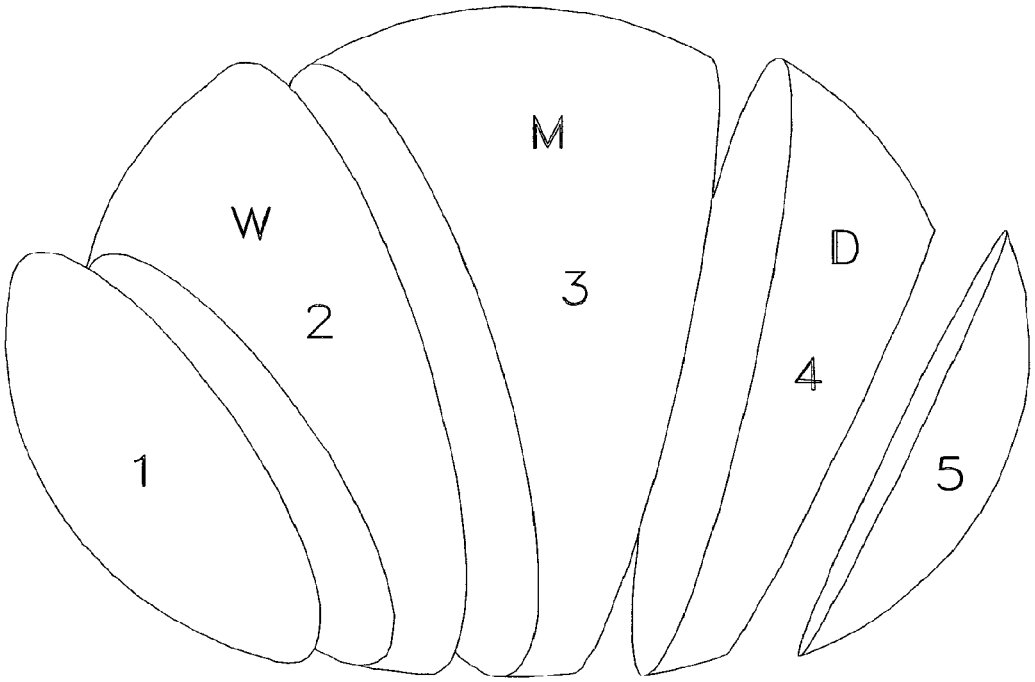
FIG. 2 illustrate the second step of the construction of my mechanisms described in the next paragraph.

C. Cut the ball BL along the planes π(w), (d), π(mw) and π(mw) into five components, say 1,2,3,4,5 (FIG. 2). Reject two extreme components 1 and 5 and save three central elements 2,3,4. These elements are segments of the ball BL bounded respectively by pairs of the planes: π(w), π(mw)), (π(mw), π(md)) and (π(d), π(md)), and are denoted by W, M, and D respectively (FIG. 2). W, M, and D are the "moving" links of the desired mechanism.

Figure 3:
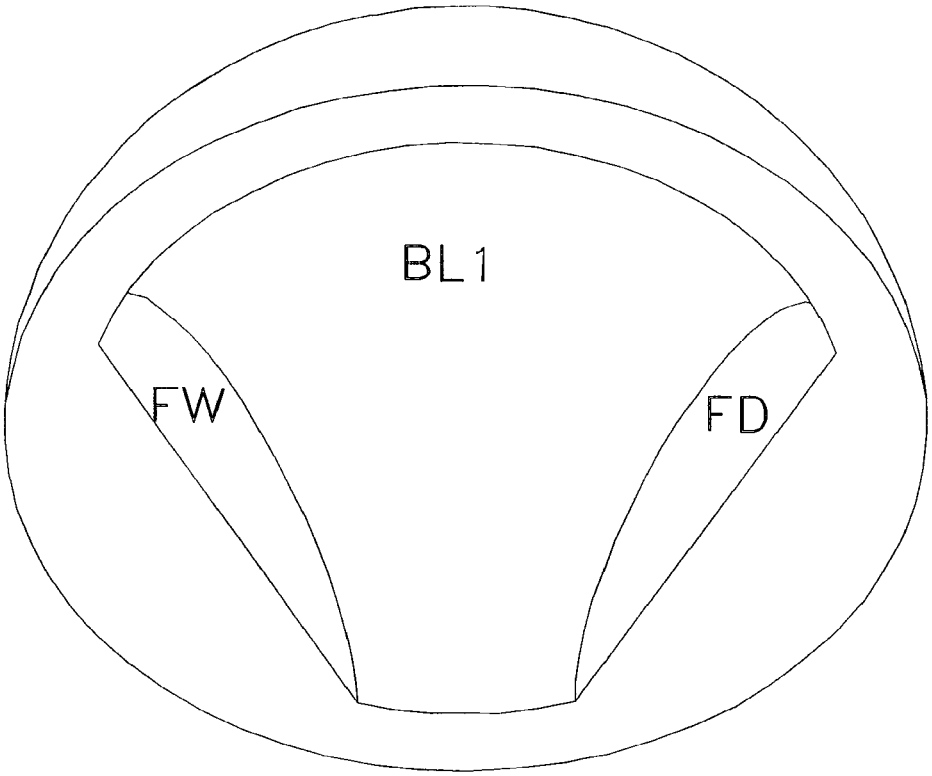
FIG. 3 illustrate the third step of the construction of my mechanisms described in the next paragraph.

D. Take another element L with (substantially) spherical bore chamber BL1 of radius R and two flat surfaces FW and FD perpendicular to the vectors $v_w$, $v_d$ respectively; the distance from the center of the chamber BL1 to the flat surface FW (resp. FD) equals the distance from the center of the ball BL to the plane π(w) (resp. π(d)) (FIG. 3). The element L will be called the body of the mechanism.

Figure 4:
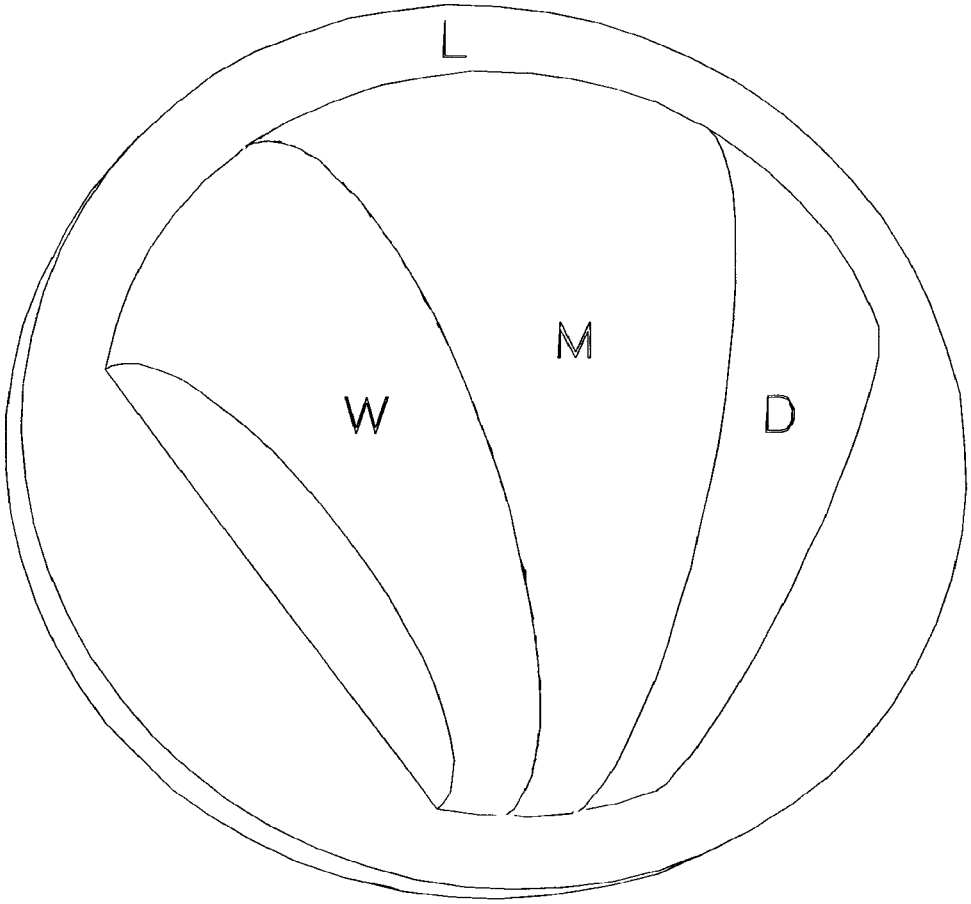
FIG. 4 illustrate the fourth step of the construction of my mechanisms described in the next paragraph.

E. Insert the elements W, M, and D in the bore chamber BL1 of the element L as shown in FIG. 4 (clearly this can be done in only one way).

The resulting device is the desired (spatial) mechanism. It has five kinetic couples, namely (L,W), (W,M), (M,D), (D,L) and (M,L). The couples (L,W), (W,M), (M,D), (D,L) are higher rotational kinetic couples, while the couple (M,L) is a lower ball joint-like kinetic couple.

Figure 5:
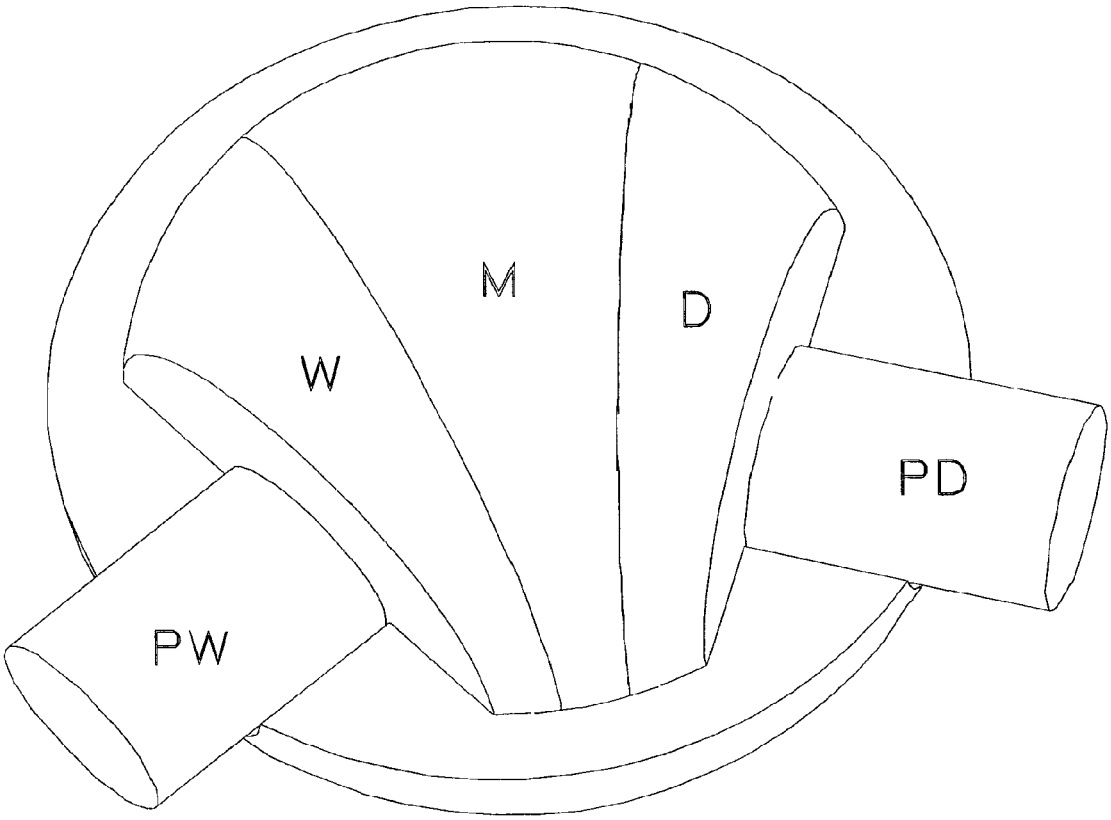
FIG. 5 illustrate the fifth step of the construction of my mechanisms described in the next paragraph.

In order to enable receiving mechanical energy produced inside the mechanism body, we have to make "moving" elements of the mechanism accessible from the exterior of the body L. This is achieved by equipping said body L with one or two circular bore chambers that accommodate a pin PW attached to the element W and/or a pin PD attached to the element D (FIG. 5).

For the purpose of the present patent specification I assume the following Definition:

DEFINITION. By a spatial eccentric is understood a segment of a ball bounded by two planes, wherein one of said planes is inclined relative the other plane at a non-zero angle, possibly equipped with a pin projecting from at least one of said two planes, and/or a bore chamber formed in the body of said segment of the ball.

REMARK 1. In general this procedure provides spatial mechanisms the "moving" elements of which assume the general form of spatial eccentric (see the Definition above), but in a limiting case it can give flat mechanisms, and in this case all the parts of the mechanism are obtained by cutting a cylinder rather than a ball into 4 pieces, each of them bearing circular symmetry. From the mathematical point of view, the flat mechanism alluded to above is a limiting case of the spatial mechanism obtained by placing the point O at infinity and letting the radius R tend to infinity. In this way we get a mechanism composed of three ordinary flat eccentrics W, M, D placed in the body L, which is composed of four higher (rotational) couples (L,W), (W,M), (M,D), (D,L). In this case the vectors $v_w$, $v_d$, $v_{mw}$, and $v_{md}$ (directional vectors of the axes of rotation of the kinetic couples) are all mutually parallel (FIGS. 6 and 7). The present invention utilizes only spatial mechanisms.

REMARK 2. It is clear from this description and accompanying figures that this is the strongest mechanism in existence (which is not merely a kinetic pair such as the ball joint) as its 3 moving parts occupy the whole internal space of its body and all its components assume general form of the ball or segments of a ball. Therefore the mechanism is particularly well suited for heavy-duty applications, including high power density, extreme loads, detonation and HCCI engines. Another unusual feature of the presented 4-link spatial mechanism is that its four elements form five kinetic pairs, namely (L,W), (W,M), (M,D), (D,L) and (M,L). The presence of an extra kinetic pair (M,L) (which is a lower ball joint-like kinetic couple) contributes significantly to the mechanism strength and further decreases specific loads.

REMARK 3. It is clear that kinetics of the spatial mechanism is determined exclusively by the relative position of the vectors $v_w$, $v_d$, $v_{mw}$ and $v_{md}$ or, equivalently, by the angles between these vectors (this will be discussed below).

Similarly, kinetics of the "flat" mechanism is determined by the distances between the axes of rotation of the mechanism elements.

In order to determine kinetics of the spatial mechanism we join the end points of the vectors $v_w$, $v_d$, $v_{mw}$ and $v_{md}$ by geodesic arcs placed in the sphere BL to obtain the ordinary spherical geodesic tetragon (FIG. 1). This proves that from the kinetic point of view our mechanism is the ordinary spherical four-bar linkage.

Similarly, from the kinetic point of view, the "flat" mechanism is the usual flat four-bar linkage. This can be seen by suitably joining by straight segments the intersection points of the rotation axes of the elements W, M and D determined by the vectors $v_w$, $v_d$, $v_{mw}$ and $v_{md}$ with a plane perpendicular to these vectors.

Thus any kinetic pair of the presented mechanism is the rotary or spherical one, and the mechanism is capable of producing rotary movement of one of its elements from oscillating movement of another element and rotary movement of one of its elements from rotary-oscillating movement of some other elements. This feature is utilized in my engines presented in the next section.

REMARK 4. Specific loads within the mechanism (given external loads applied to the mechanism) depend on the relative position of the vectors $v_w$, $v_d$, $v_{mw}$, and $v_{md}$, as well as on the radius R and distances from the center O to the planes π(w), π(d), π(mw) and π(md). This problem will be briefly discussed in forthcoming paragraphs.

REMARK 5. It is worth noticing that the presented mechanism is not only simple structurally, but also easy to manufacture. All its moving elements have the same very simple structure thus can be manufactured using the same general-purpose machines like forging machine, lathe and milling machine, quite unlike the mechanism of the ordinary piston engine comprising technologically different and complicated elements (crankshaft) and requiring highly specialized equipment to manufacture.

Throughout the patent specification I will use the following nomenclature: The three moving elements (segments of the ball) of the mechanism obtained by the procedure described above I will call "spatial eccentrics" or simply eccentrics. When applied to spherical engine I will call these elements as follows: W=2–main spatial eccentric, or the main shaft, when this element does not assume the shape of spatial eccentric, M=4–intermediate spatial eccentric, D=3–secondary spatial eccentric, or auxiliary shaft, when this element does not assume the shape of spatial eccentric; the name "main spatial eccentric" is reserved for the element used to receive driving torque, and this element (spatial eccentric) is usually equipped with a pin or a shaft to receive useful power.

Below I present a rotary/oscillating spherical engine utilizing a variant of the spatial mechanism constructed above. The design is based on the following three principles:

PRINCIPLE 1. Cut out the combustion chambers (or "pistons") in some elements of the mechanism presented above.

PRINCIPLE 2. Make the engine producing as many power strokes per revolution as possible. Make phasing of power strokes optimum.

PRINCIPLE 3. Make the engine as well balanced as possible.

1. Rotary/Oscillating Spherical Engine (FIGS. 6-14)

The engine is a HCCI rotary one having 3 moving parts and producing two power strokes per shaft revolution (let us note that rotary "spatial" engines with only 3 moving parts and producing 4 and even 6 power strokes per shaft revolution are also within the scope of the presented invention). It utilizes the mechanism shown in FIG. 5 with geometric parameters described below.

The engine has 3 moving parts: main spatial eccentric 2=W, intermediate spatial eccentric 4=M, and secondary spatial eccentric 3=D equipped with suitable spherical and flat surfaces used to determine engine's kinetics. The geometric parameters of the mechanism are as follows: the angle w between the axis of rotation of the main spatial eccentric 2 relative the body 1 and the axis of rotation of the intermediate spatial eccentric 4 relative the main spatial eccentric 2 and the angle d between the axis of rotation of the secondary spatial eccentric 3 relative the body 1 and the angle of rotation of the intermediate spatial eccentric 4 relative the secondary spatial eccentric 3, are both smaller than the angle m between the axes of rotation of the intermediate spatial eccentric 4 relative the main 2 and secondary 3 spatial eccentrics (and preferably the angle w between the axis of rotation of the main spatial eccentric 2 relative the body 1 and the axis of rotation of the intermediate spatial eccentric 4 relative the main spatial eccentric 2 equals the angle d between the axis of rotation of the secondary spatial eccentric 3 relative the body 1 and the angle of rotation of the intermediate spatial eccentric 4 relative the secondary spatial eccentric 3); moreover the angle m between the axes of rotation of the intermediate spatial eccentric 4 relative the main 2 and secondary 3 spatial eccentrics is greater than the angle l between the axes of rotation of the main 2 and secondary 3 spatial eccentrics relative the body 1. Thanks to this specific geometry the mechanism produces rotary movement with non-constant rotational speed of the secondary spatial eccentric from the rotary movement with constant rotational speed of the main spatial eccentric, and both the kinetic couples (2,4) and (3,4) are oscillating ones. Moreover the angles w and d (resp. m and l) are both smaller (greater) than the right angle.

Massive main spatial eccentric 2 (FIGS. 11, 12) has its "cold section" and "hot section". The "cold section" has a spherical portion 2S and a shaft (or pin) 2A projecting from the spherical portion. The "hot section" of main spatial eccentric 2 has a "hot" flat surface 2F1 (used to define engine mechanism's kinetics), which carry 3 massive fins (or pistons) 2P; the outer surface 2PO of the pistons (which matches the inner surface of the engine main spherical chamber) is spherical. The main spatial eccentric 2 has also a central tubular portion 2R supporting the pistons at their inner side. There is a centrally placed circular air passage 2CP in said tubular section 2R of the "hot section" of the main spatial eccentric 2 and 3 assemblies of radially disposed air passages 2AP placed between pistons 2P in constant communication with said central air passage 2CP. There are also three assemblies of hot gas outlet passages 20P placed in the massive spherical section 2S of the main spatial eccentric 2; the hot gas passages at their one end have inlet ports 2*a* placed between the pistons 2P, and at their other end have outlet ports 2*z* placed on the spherical surface of the spherical section 2S of the main spatial eccentric 2.

Intermediate spatial eccentric 4 (FIGS. 11, 12) has its spherical section 4S confined by a "hot" circular flat surface 4F1 matching the "hot" flat surface 2F1 of the main spatial eccentric 2 and "cold" circular flat surface 4F inclined one relative the other at an angle dictated by the mechanism kinetics. The "hot" flat surface 4F1 carries three massive fins (or pistons) 4P cooperating with the pistons 2P placed on the main spatial eccentric 2. There is also a central circular air passage 4CP placed in the intermediate spatial eccentric 4.

Secondary spatial eccentric 3 (FIGS. 8, 9, 10, 13) has its spherical section 3S, which at one side has flat circular surface 3F cooperating with the "cold" flat surface 4F of the intermediate 4; at the other side of said spherical portion 3S of the secondary spatial eccentric 3 there is a massive pin 3A inclined at a suitable angle relative the flat surface 3F dictated by engine mechanism's kinetics. Cutting through the secondary spatial eccentric 3 there is a circular air passage 3CP with an air inlet 31 placed at the pin 3A. The pin 3A of secondary spatial eccentric 3 drives the fuel injector, thus there are suitable cams placed on it (not shown).

Engine's moving elements are constructed so as to minimize moment of inertia of the intermediate 4 and secondary 3 spatial eccentrics in comparison with the moment of inertia of the main spatial eccentric 2, which is used to receive driving torque.

Engine's body 1=L has spherical central section 1S with a spherical working chamber SC housing spherical sections of all three moving elements of the engine, and is composed of two parts 1A and 1B. Placed in the body 1 there is a circular aperture 12 housing a bearing supporting the pin 2A of the main spatial eccentric 2, and a spiral gas collector GC in communication with hot gas outlet ports 2*z* placed on the spherical section of the main spatial eccentric 2; there is a gas outlet GO at one end of the spiral gas collector. Placed in the body 1 there is a circular aperture 13 housing a bearing supporting the pin 3A of the secondary spatial eccentric 3, a collection of circular air inlets In communication with the air passage 3CP in auxiliary spatial eccentric 3, and a fuel injector J placed in proximity to said air inlets In.

Thus the engine has six combustion chambers CC1-CC6 confined by the (double-acting) pistons 2P and 4P, "hot" flat surfaces 2F1 and 4F1 of the main 2 and intermediate 4 spatial eccentrics, and the spherical wall of engine's working chamber SC.

Opening and closing of the air inlet passages 2AP and hot gases outlet passages 2*a* are governed by the pistons 4P of the intermediate spatial eccentric 4.

In this design w, d<90°, and m, 1>90°.

Sealing rings (with spherical outer surface) and sealing bars provide sealing of the engine (not shown). Thus the sealing is completely symmetric and as simple, tight and reliable as that of ordinary piston engines.

Here is a brief discussion of the engine work. The assembly of six combustion chambers CC1-CC6 is naturally divided into two sub-assemblies of three chambers each: CC1, CC3, CC5 and CC2, CC4, CC6. As the moving engine's parts rotate (to be more precise, as the main spatial eccentric 2 rotates with a constant rotational speed, the secondary spatial eccentric 3 rotates with changing rotational speed and the intermediate spatial eccentric 4 executes a compound rotational/wobbling motion relative engine's body 1), volume of any combustion chamber of one sub-assembly increases and volume of any combustion chamber of the other sub-assembly decreases. As volume of one group of the combustion chambers approaches its maximum, the pistons of the intermediate spatial eccentric 4 open the inlet ports 2*a* placed between the pistons 2P on the "hot" flat surface 2F1 of the main spatial eccentric 2 and hot low-pressure gases driven by centrifugal forces exit said combustion chambers through said ports, flow through the hot gas passages 20P placed in the spherical section of the main spatial eccentric, enter the spiral gas collector GC in engine's body, and are finally exhausted. Next, as volume of the combustion chambers still rises, the pistons open air inlet ports 2AP placed on the "hot" tubular portion 2R of main spatial eccentric 2.

Fresh air, driven by centrifugal forces, enter the inlet port In placed on the engine body 1, fuel is injected by the injector J, and homogeneous charge is prepared in the air passages 3CP, 4CP, and 2CP placed in the secondary 3, intermediate 4 and main 2 spatial eccentrics respectively (FIG. 13). Then the air/fuel mixture passes through the central air passages in engine's spatial eccentrics, and enters the three combustion chambers through the air passages 2AP displacing remaining hot low-pressure gases; this is the scavenging. Next, as the spatial eccentrics further rotate, volume of the combustion chambers decreases, the pistons close the inlet and outlet ports, and the homogeneous charge contained in said combustion chambers is compressed. As volume of the combustion chambers approaches their minimum, the homogeneous charge is ignited and hot high-pressure gases produced. Next the gases expand producing useful power (received from the main spatial eccentric 2). Next the whole process repeats with the two sub-assemblies of the combustion chambers subsequently interchanging their roles.

In this brief discussion I completely ignore the subtle problem of controlling this HCCI engine, as this is beyond the scope of the present patent application, the focus of which is on the mechanical aspects of the engine. Let us note that there is also a mechanically similar engine working on traditional Diesel cycle, the general layout of which (including the effective centrifugal forces-enhanced uniflow scavenging system) is completely analogous, with the only essential difference being a plurality of injectors adjacent to the combustion chambers (some minor structural changes are also required).

The foregoing description discloses one preferred embodiment of the invention. One skilled in the art will readily recognize from this description and from the accompanying figures, that many changes and modifications can be made to the preferred embodiment without departing from the true spirit, scope and nature of the inventive concepts as described in this disclosure.

The invention claimed is:

1. A spherical internal combustion engine, comprising:

a. an engine body;

b. a main spatial eccentric including:

a segment of ball bounded by a first circular plane and a second circular plane, and a first spherical surface, wherein said second circular plane is not parallel to said first circular plane;

c. an intermediate spatial eccentric including:

a segment of ball bounded by a third circular plane and a fourth circular plane, and a second spherical surface, wherein said fourth circular plane is not parallel to said third circular plane;

d. a secondary spatial eccentric including:

a segment of ball bounded by a fifth circular plane and a sixth circular plane, and a third spherical surface, wherein said sixth circular plane is not parallel to said fifth circular plane;

e. air inlet ports placed in said engine body;

f. hot gases exhaust ports placed in said engine body;

g. a fuel injection apparatus mounted in said engine body;

h. a power takeoff main pin projects;

wherein said power takeoff main pin projects from said first circular plane bounding said main spatial eccentric;

i. a number n of main spatial eccentric fins;

wherein said number n of main spatial eccentric fins project from said second circular plane bounding said main spatial eccentric;

j. number n of intermediate spatial eccentric fins;

wherein said number n of intermediate spatial eccentric fins project from said third circular plane bounding said intermediate spatial eccentric;

k. a secondary pin projecting from said sixth circular plane of said secondary spatial eccentric;

(i) wherein said engine body, said main spatial eccentric, said secondary spatial eccentric, and said intermediate spatial eccentric form a spherical four-bar linkage converting thermal energy of combustion gases to rotational motion;

(ii) wherein said engine body further includes;

a spherical working chamber having a spherical working chamber inner spherical wall, a spherical working chamber center O, a first cylindrical chamber having a first axis of symmetry, and a second cylindrical chamber having a second axis of symmetry, wherein said first axis of symmetry of said first cylindrical chamber and said second axis of symmetry of said second cylindrical chamber intersect at the spherical working chamber center O;

(iii) wherein the main spatial eccentric, the intermediate spatial eccentric, and the secondary spatial eccentric are mounted rotatably inside said spherical working chamber, so that the first spherical surface of the main spatial eccentric, the second spherical surface of the intermediate spatial eccentric, and the third spherical surface of the secondary spatial eccentric slide over said spherical working chamber inner spherical wall;

(iv) wherein said intermediate spatial eccentric is placed between said main spatial eccentric and said secondary spatial eccentric, so that said intermediate spatial eccentric fins are mounted between said main spatial eccentric fins to form 2n combustion chambers, and so that said third circular plane bounding said intermediate spatial eccentric slides over said second circular plane bounding said main spatial eccentric, and said fourth circular plane bounding said intermediate spatial eccentric slides over said fifth circular plane bounding said secondary spatial eccentric;

(v) wherein said power takeoff main pin of said main spatial eccentric is mounted rotatably in said first cylindrical chamber included in said engine body, so that said main spatial eccentric and said engine body define a first rotary kinetic couple of said spherical four-bar linkage converting thermal energy of combustion gases to rotational motion, wherein said first rotary kinetic couple of said spherical four-bar linkage converting thermal energy of combustion gases to rotational motion defines a first axis Vw of rotation of said main spatial eccentric relative said engine body, wherein said first axis Vw of rotation of said main spatial eccentric relative said engine body coincides with said first axis of symmetry of said first cylindrical chamber included in said engine body;

(vi) wherein said secondary pin of said secondary spatial eccentric is mounted rotatably in said second cylindrical chamber included in said engine body, so that said secondary spatial eccentric and said engine body define a second rotary kinetic couple of said spherical four-bar linkage converting thermal energy of combustion gases to rotational motion, wherein said second rotary kinetic couple of said spherical four-bar linkage converting thermal energy of combustion gases to rotational motion defines a second axis Vd of rotation of said secondary spatial eccentric relative said engine body, wherein said second axis Vd of rotation of said secondary spatial eccentric relative said engine body coincides with said second axis of symmetry of said second cylindrical chamber included in said engine body;

(vii) wherein said intermediate spatial eccentric and said main spatial eccentric define a third rotary kinetic couple of said spherical four-bar linkage converting thermal energy of combustion gases to rotational motion, wherein said third rotary kinetic couple of said spherical four-bar linkage converting thermal energy of combustion gases to rotational motion defines a third axis Vmw of rotation of said intermediate spatial eccentric relative said main spatial eccentric;

(viii) wherein said intermediate spatial eccentric and said secondary spatial eccentric define a fourth rotary kinetic couple of said spherical four-bar linkage converting thermal energy of combustion gases to rotational motion, wherein said fourth rotary kinetic couple of said spherical four-bar linkage converting thermal energy of combustion gases to rotational motion defines a fourth axis Vmd of rotation of said intermediate spatial eccentric relative said secondary spatial eccentric;

(ix) wherein said intermediate spatial eccentric and said engine body form a fifth kinetic couple of said spherical four-bar linkage converting thermal energy of combustion gases to rotational motion, wherein said fifth kinetic couple of said spherical four-bar linkage converting thermal energy of Combustion gases to rotational motion is a spherical kinetic couple;

(x) wherein the first axis Vw of rotation, the second axis Vd of rotation, the third axis Vmw of rotation, and the fourth axis Vmd of rotation intersect at the spherical working chamber center O;

(xi) wherein said first axis Vw of rotation of said main spatial eccentric relative said engine body is inclined relative said second axis Vd of rotation of said secondary spatial eccentric relative said engine body by a first non-zero angle l, wherein the first non-zero angle l is not equal to the right angle;

(xii) wherein said third axis Vmw of rotation of said intermediate spatial eccentric relative said main spatial eccentric is inclined relative the fourth axis Vmd of rotation of said intermediate spatial eccentric relative said secondary spatial eccentric by a second non-zero angle m, wherein the second non-zero angle m is not equal to the right angle;

(xiii) wherein said first axis Vw of rotation of said main spatial eccentric relative said engine body is inclined relative the third axis Vmw of rotation of said intermediate spatial eccentric relative said main spatial eccentric by a third non-zero angle w, wherein the third non-zero angle w is smaller than the right angle; and (xiv) wherein said second axis Vd of rotation of said secondary spatial eccentric relative said engine body is inclined relative the fourth axis Vmd of rotation of said intermediate spatial eccentric relative said secondary spatial eccentric by a fourth non-zero angle d, wherein the fourth non-zero angle d is smaller than the right angle.

2. The spherical internal combustion engine as defined in claim 1, wherein said third angle w of inclination of said first axis Vw of rotation of said main spatial eccentric relative said engine body relative the third axis Vmw of rotation of said intermediate spatial eccentric relative said main spatial eccentric is equal to said fourth angle d of inclination of said second axis Vd of rotation of said secondary spatial eccentric relative said engine body relative the fourth axis Vmd of rotation of said intermediate spatial eccentric relative said secondary spatial eccentric.

3. The spherical internal combustion engine according to claim 1, wherein said engine body includes a circular hot gases collector being placed on the first spherical surface of said main spatial eccentric.

4. The spherical internal combustion engine according to claim 1, wherein said engine body further includes air passages being connected to the central part of said secondary spatial eccentric.

5. The spherical internal combustion engine according to claim 4, wherein the secondary spatial eccentric includes an air passage being placed at the central part of said secondary spatial eccentric in constant communication with said air passages placed in the engine body;

wherein the intermediate spatial eccentric includes an air passage being placed at the central part of said intermediate spatial eccentric in constant communication with said air passage placed in the secondary spatial eccentric;

wherein said main spatial eccentric includes a primary air passage being placed at the central part of said main spatial eccentric in constant communication with said air passage placed in the intermediate spatial eccentric;

wherein said main spatial eccentric includes secondary air passages being disposed radially in said central part of said main spatial eccentric; and wherein said secondary air passages being disposed radially in said central part of said main spatial eccentric have inlet openings being placed in said primary air passage placed in the central part of the main spatial eccentric, and outlet openings being placed between said main spatial eccentric fins.

6. A spherical internal combustion engine, comprising:

a. an engine body;

b. a main spatial eccentric including:

a segment of ball bounded by a first circular plane and a second circular plane, and a first spherical surface, wherein said second circular plane is not parallel to said first circular plane;

c. an intermediate spatial eccentric including:

a segment of ball bounded by a third circular plane and a fourth circular plane, and a second spherical surface, wherein said fourth circular plane is not parallel to said third circular plane;

d. a secondary spatial eccentric including:

a segment of ball bounded by a fifth circular plane and a sixth circular plane, and a third spherical surface, wherein said sixth circular plane is not parallel to said fifth circular plane;

e. air inlet ports placed in said engine body;

f. hot gases exhaust ports placed in said engine body;

g. a fuel injection apparatus mounted in said engine body;

h. a power takeoff main pin projects;

wherein said power takeoff main pin projects from said first circular plane bounding said main spatial eccentric;

i. a number n of main spatial eccentric fins;

wherein said number n of main spatial eccentric fins project from said second circular plane bounding said main spatial eccentric;

j. number n of intermediate spatial eccentric fins;

wherein said number n of intermediate spatial eccentric fins project from said third circular plane bounding said intermediate spatial eccentric;

(i) wherein said engine body, said main spatial eccentric, said secondary spatial eccentric, and said intermediate spatial eccentric form a spherical four-bar linkage converting thermal energy of combustion gases to rotational motion;

(ii) wherein said engine body further includes;

a spherical working chamber having a spherical working chamber inner spherical wall, a spherical working chamber center O, a first cylindrical chamber having a first axis of symmetry, and a seventh circular plane having a second axis of symmetry perpendicular to said seventh circular plane, wherein said first axis of symmetry of said first cylindrical chamber and said second axis of symmetry of said seventh circular plane intersect at the spherical working chamber center O;

(iii) wherein the main spatial eccentric, the intermediate spatial eccentric, and the secondary spatial eccentric are mounted rotatably inside said spherical working chamber, so that the first spherical surface of the main spatial eccentric, the second spherical surface of the intermediate spatial eccentric, and the third spherical surface of the secondary spatial eccentric slide over said spherical working chamber inner spherical wall;

(iv) wherein said intermediate spatial eccentric is placed between said main spatial eccentric and said secondary spatial eccentric, so that said intermediate spatial eccentric fins are mounted between said main spatial eccentric fins to form 2n combustion chambers, and so that said third circular plane bounding said intermediate spatial eccentric slides over said second circular plane bounding said main spatial eccentric, and said fourth circular plane bounding said intermediate spatial eccentric slides over said fifth circular plane bounding said secondary spatial eccentric;

(v) wherein said power takeoff main pin of said main spatial eccentric is mounted rotatably in said first cylindrical chamber included in said engine body, so that said main spatial eccentric and said engine body define a first rotary kinetic couple of said spherical four-bar linkage converting thermal energy of combustion gases to rotational motion, wherein said first rotary kinetic couple of said spherical four-bar linkage converting thermal energy of combustion gases to rotational motion defines a first axis Vw of rotation of said main spatial eccentric relative said engine body, wherein said first axis Vw of rotation of said main spatial eccentric relative said engine body coincides with said first axis of symmetry of said first cylindrical chamber included in said engine body;

(vi) wherein said sixth circular plane bounding said secondary spatial eccentric slides over said seventh circular plane included in said engine body, so that said secondary spatial eccentric and said engine body define a second rotary kinetic couple of said spherical four-bar linkage converting thermal energy of combustion gases to rotational motion, wherein said second rotary kinetic couple of said spherical four-bar linkage converting thermal energy of combustion gases to rotational motion defines a second axis Vd of rotation of said secondary spatial eccentric relative said engine body, wherein said second axis Vd of rotation of said secondary spatial eccentric relative said engine body coincides with said second axis of symmetry of said seventh circular plane included in said engine body;

(vii) wherein said intermediate spatial eccentric and said main spatial eccentric define a third rotary kinetic couple of said spherical four-bar linkage converting thermal energy of combustion gases to rotational motion, wherein said third rotary kinetic couple of said spherical four-bar linkage converting thermal energy of combustion gases to rotational motion defines a third axis Vmw of rotation of said intermediate spatial eccentric relative said main spatial eccentric;

(viii) wherein said intermediate spatial eccentric and said secondary spatial eccentric define a fourth rotary kinetic couple of said spherical four-bar linkage converting thermal energy of combustion gases to rotational motion, wherein said fourth rotary kinetic couple of said spherical four-bar linkage converting thermal energy of combustion gases to rotational motion defines a fourth axis Vmd of rotation of said intermediate spatial eccentric relative said secondary spatial eccentric;

(ix) wherein said intermediate spatial eccentric and said engine body form a fifth kinetic couple of said spherical four-bar linkage converting thermal energy of combustion gases to rotational motion, wherein said fifth kinetic couple of said spherical four-bar linkage converting thermal energy of combustion gases to rotational motion is a spherical kinetic couple;

(x) wherein the first axis Vw of rotation, the second axis Vd of rotation, the third axis Vmw of rotation, and the fourth axis Vmd of rotation intersect at the spherical working chamber center O;

(xi) wherein said first axis Vw of rotation of said main spatial eccentric relative said engine body is inclined relative said second axis Vd of rotation of said secondary spatial eccentric relative said engine body by a first non-zero angle l, wherein the first non-zero angle l is not equal to the right angle;

(xii) wherein said third axis Vmw of rotation of said intermediate spatial eccentric relative said main spatial eccentric is inclined relative the fourth axis Vmd of rotation of said intermediate spatial eccentric relative said secondary spatial eccentric by a second non-zero angle m, wherein the second non-zero angle m is not equal to the right angle;

(xiii) wherein said first axis Vw of rotation of said main spatial eccentric relative said engine body is inclined relative the third axis Vmw of rotation of said intermediate spatial eccentric relative said main spatial eccentric by a third non-zero angle w, wherein the third non-zero angle w is smaller than the right angle; and (xiv) wherein said second axis Vd of rotation of said secondary spatial eccentric relative said engine body is inclined relative the fourth axis Vmd of rotation of said intermediate spatial eccentric relative said secondary spatial eccentric by a fourth non-zero angle d, wherein the fourth non-zero angle d is smaller than the right angle.

* * * * *